US007225481B2

(12) United States Patent
Culmer

(10) Patent No.: US 7,225,481 B2
(45) Date of Patent: Jun. 5, 2007

(54) TOILET AND TOILET INSERT

(76) Inventor: Neugyen Culmer, Richards Addition 01, P.O. Box CB 11034, Nassau (BS)

( * ) Notice: Subject to any disclaimer, the term of this patent is extended or adjusted under 35 U.S.C. 154(b) by 0 days.

(21) Appl. No.: 11/201,148

(22) Filed: Aug. 11, 2005

(65) Prior Publication Data

US 2005/0278846 A1 Dec. 22, 2005

Related U.S. Application Data

(62) Division of application No. 10/983,657, filed on Nov. 9, 2004, now Pat. No. 6,948,195.

(30) Foreign Application Priority Data

Jan. 23, 2004 (BS) ..... 1640

(51) Int. Cl.
*A47K 11/00* (2006.01)
*E03D 9/00* (2006.01)

(52) U.S. Cl. ..... 4/661; 4/144.3; 4/300.3; 4/420.3; 4/DIG. 5

(58) Field of Classification Search ..... 4/234, 4/237, 300.3, 311, 420, 420.3, 661, 144.4, 4/DIG. 5, 144.1–144.3; 604/317
See application file for complete search history.

(56) References Cited

U.S. PATENT DOCUMENTS

| | | | | |
|---|---|---|---|---|
| 2,185,887 | A | 1/1940 | Dennis | 4/420 |
| 2,600,478 | A * | 6/1952 | Butcher | 4/144.4 |
| 2,801,424 | A * | 8/1957 | Mercer | 4/661 |
| 4,437,430 | A * | 3/1984 | DeBardeleben | 4/300.3 |
| 4,612,676 | A * | 9/1986 | Whitman | 4/300.3 |
| 4,910,815 | A * | 3/1990 | Kelley | 4/661 |
| 5,960,481 | A | 10/1999 | Deveer | 4/237 |
| 6,085,365 | A | 7/2000 | Chiang | 4/420 |
| 6,314,591 | B1 | 11/2001 | Schildt | 4/420 |

* cited by examiner

*Primary Examiner*—Tuan Nguyen
(74) *Attorney, Agent, or Firm*—Wenderoth, Lind & Ponack, L.L.P.

(57) ABSTRACT

A comfortable elongated toilet designed for men to sit on the toilet to urinate and dispose of water without contaminating the penis. The Big Boys Cave has a Big Boys Rest to position the penis horizontally. This horizontal position avoids the penis from dropping into the toilet thus preventing men from picking up germs on their penis from the waste in the toilet.

2 Claims, 12 Drawing Sheets

TOILET AND TOILET INSERT

This application is a divisional of U.S. application Ser. No. 10/983,657, filed Nov. 9, 2004 now U.S. Pat. No. 6,948,195, now allowed.

BACKGROUND OF THE INVENTION

The present invention relates to toilets, and in particular, toilets for use by males.

FIG. 1 illustrates a conventional toilet 100 that includes a tank 102, a base 104, a bowl 106, a seat 108, and spacers 110. As illustrated in FIG. 1, when seat 108 is located in the seating use position, spacers 110 rest on bowl 106. In the seating use position, as a result of the spacers separating seat 108 from bowl 106, a space 112 is provided.

As bowl 106 is designed to receive solid and liquid waste, bowl 106 is conducive to bacterial, viral and fungal growth. Accordingly, water in bowl 106 is typically contaminated.

There are two problems associated with the use of toilet 100 by males.

In particular, when an adult male is sitting on toilet 100, there is a chance that the flaccid penis of the adult male will contact the contaminated water in bowl 106 thereby increasing chances of infection. Further a contaminated penis can pass the contamination to others during sexual intercourse and lead to other infections. In particular, the contamination, if transferred to a female, can result in a yeast infection.

The second problem deals with space 112. Specifically, there is a chance that the location of the head of the penis at some point in time, will be positioned such that during urination, urine will discharge through space 112 thereby wetting the outside of the toilet and the floor.

SUMMARY OF THE INVENTION

The present invention improves the problems associated with prior art toilet discussed above.

The purpose of the present invention is to provide a clean healthy waste disposal environment for males and females.

The present invention is directed to a toilet and toilet insert that protects the penis from contamination in the bowl and prevents urine from discharging out of a space between the seat and the bowl. Specifically, a penis rest is disposed in the bowl to allow the penis to be positioned in a horizontal manner to prevent the penis from dropping into the contaminated water of the bowl to thereby avoid contracting infections. Further, an extended front portion prevents urine from wetting the outside of the toilet and the floor.

In accordance with one embodiment of the present invention, a toilet includes a penis rest, a plurality of holes operable to permit a discharge of cleaning fluid into the bowl of the toilet and a urine disposal portion. The urine disposal portion may include a projected lip disposed so as to prevent urine from escaping from outside of the toilet, a urine disposal path, a gas trap and an outlet for disposing urine into the toilet bowl.

In accordance with another embodiment of the present invention, a toilet insert comprises a penis shelf, a projected lip, a disposal path, trap and outlet.

Additional objects, advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate exemplary embodiments of the present invention and, together with the description, serve to explain the principles of the invention. In the drawings.

DETAILED DESCRIPTION OF THE INVENTION

An exemplary embodiment of a toilet in accordance with the present invention comprises any material used for conventional toilets, for example porcelain.

The present invention allows men to sit at all times to both urinate and defecate.

Figure 1:
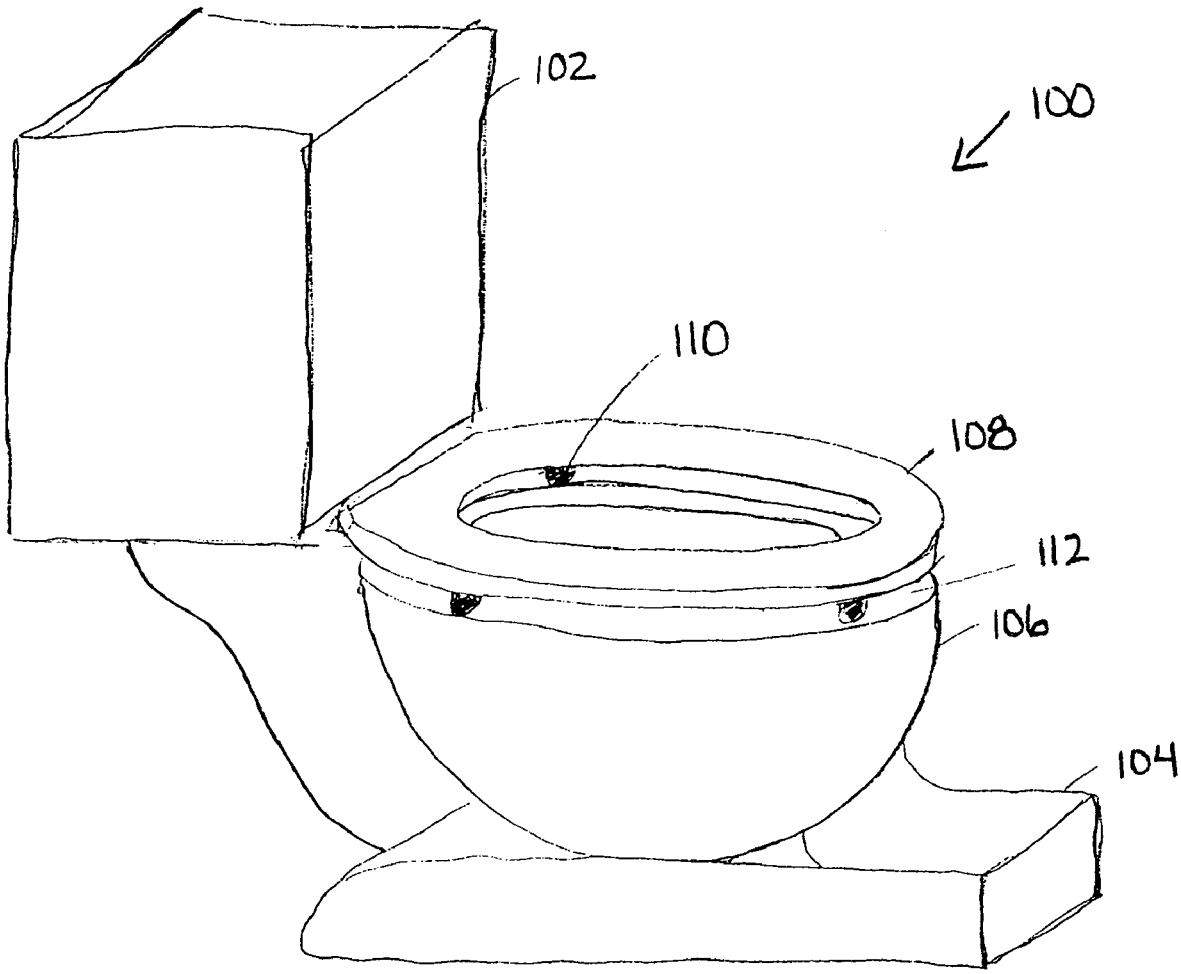
FIG. 1 PRIOR ART
FIG. 1 is an oblique view of a prior art conventional toilet.
Figure 2:
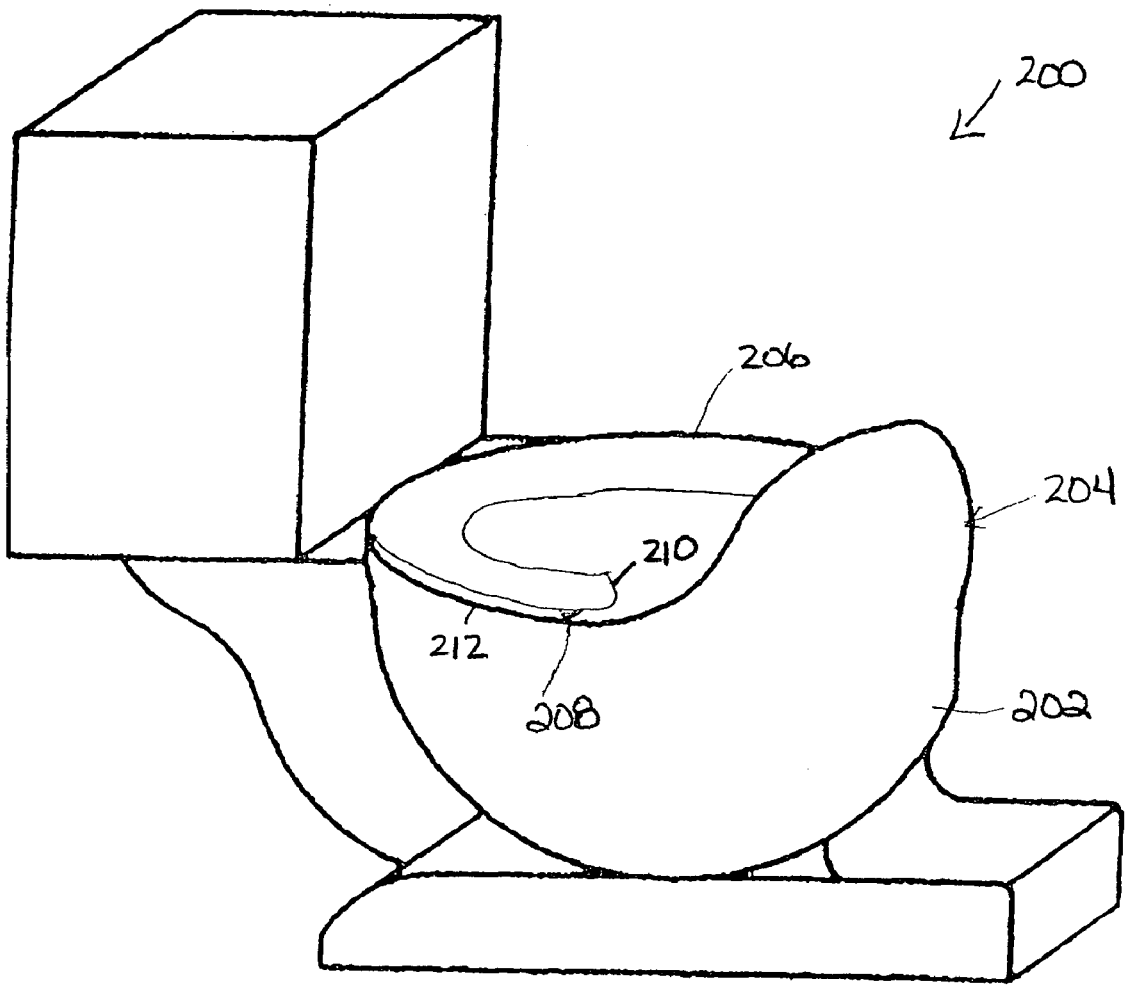
FIG. 2 is an oblique view of a toilet with an extended portion at the top of the bowl in accordance with an exemplary embodiment of the present invention.

FIG. 2 is an oblique view of a toilet 200 with an extended portion 204 at the top of the bowl 202 in accordance with an exemplary embodiment of the present invention. Toilet 200 additionally includes a liftable seat portion 206 having optional spacers 208 to space the seat portion 206 from the top portion of bowl 202 and two end portions 210. End portions 210 are arranged to prevent obstruction, by extended portion 204, of placement of seat portion 206 onto the top portion of bowl 202. Extended portion 204 prevents urine from escaping over the top portion of bowl 202.

Figure 3:
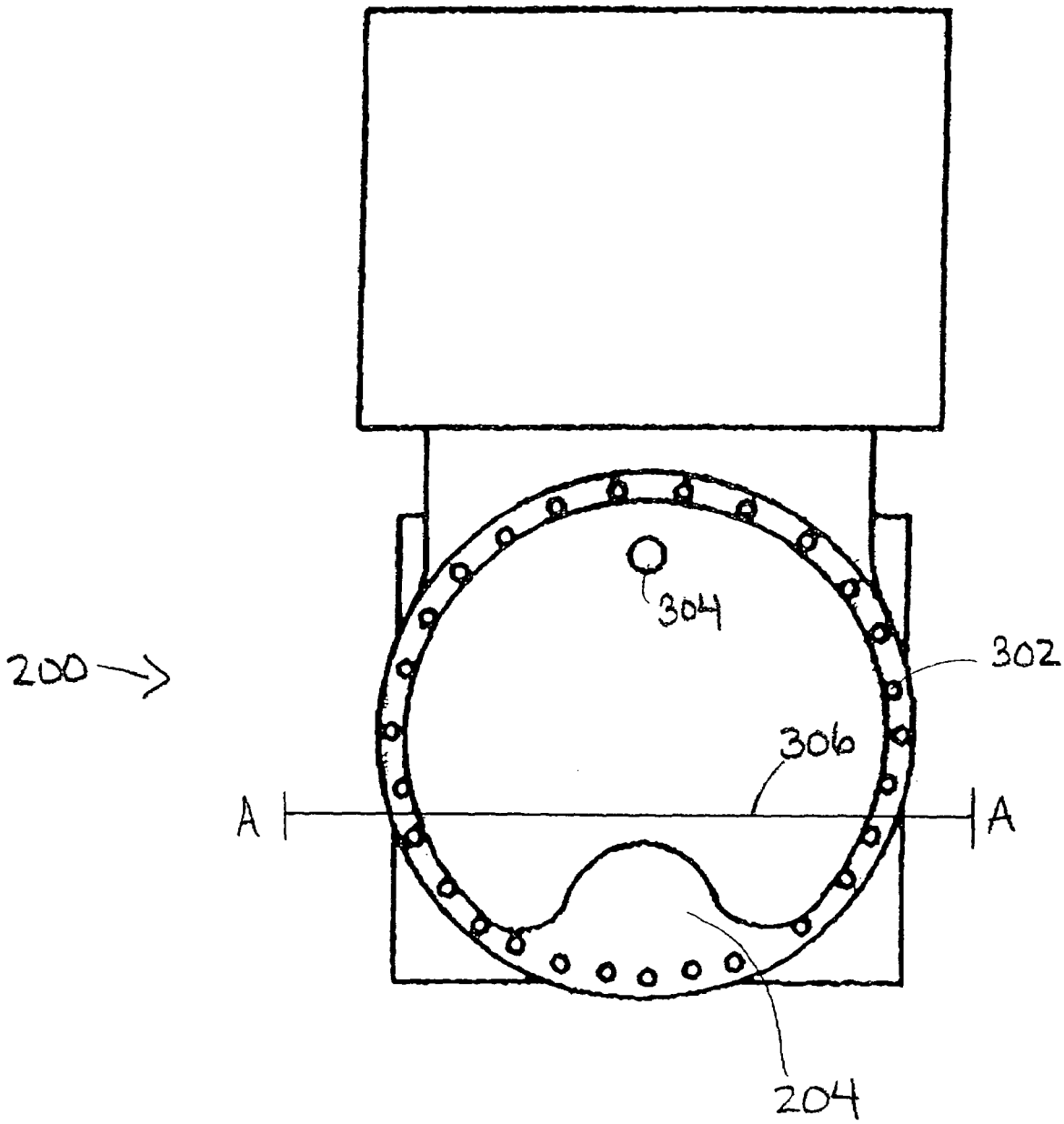
FIG. 3 is a plan view of the toilet of FIG. 2.

FIG. 3 is a plan view of toilet 200. As illustrated in FIG. 3, toilet 200 includes a plurality of discharge holes 302 arranged about the parameter of the top portion of bowl 202. Toilet 200 additionally includes a hole 304 arranged and constructed to permit flushing of contents of the bowl 202. Further, toilet 200 includes a shelf 306 arranged and designed to permit a penis to rest thereon.

Figure 4:
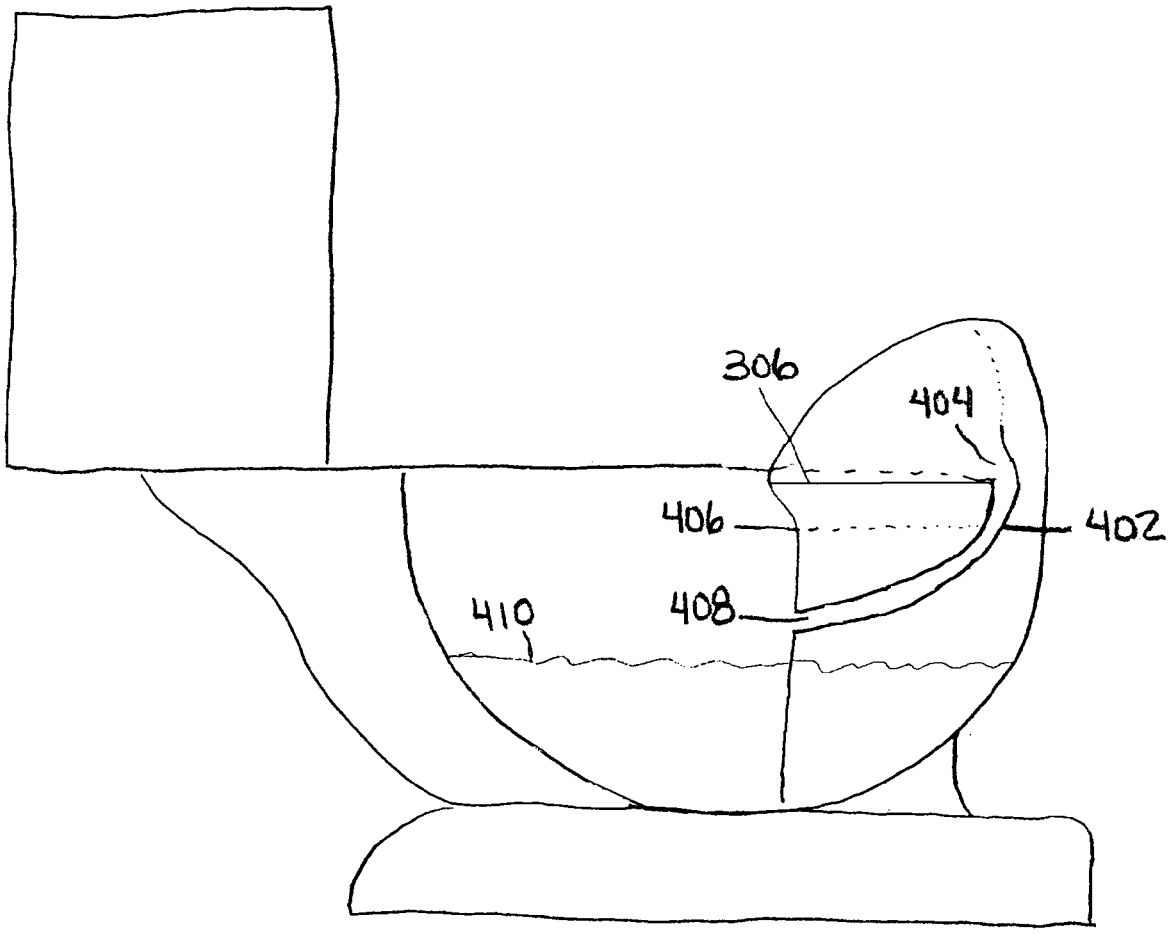
FIG. 4 is a cross-sectional side view of the toilet of FIG. 2.

FIG. 4 is a side view of toilet 200 of FIG. 2. As illustrated in FIG. 4, toilet 200 includes a urine removal portion having opening 404, disposal path 402, trap 406 and outlet 408. As illustrated in FIG. 4, outlet 408 is disposed so as to be below waterline 410 in order to permit the urine to be discharged into the water in the bowl.

Figure 5:
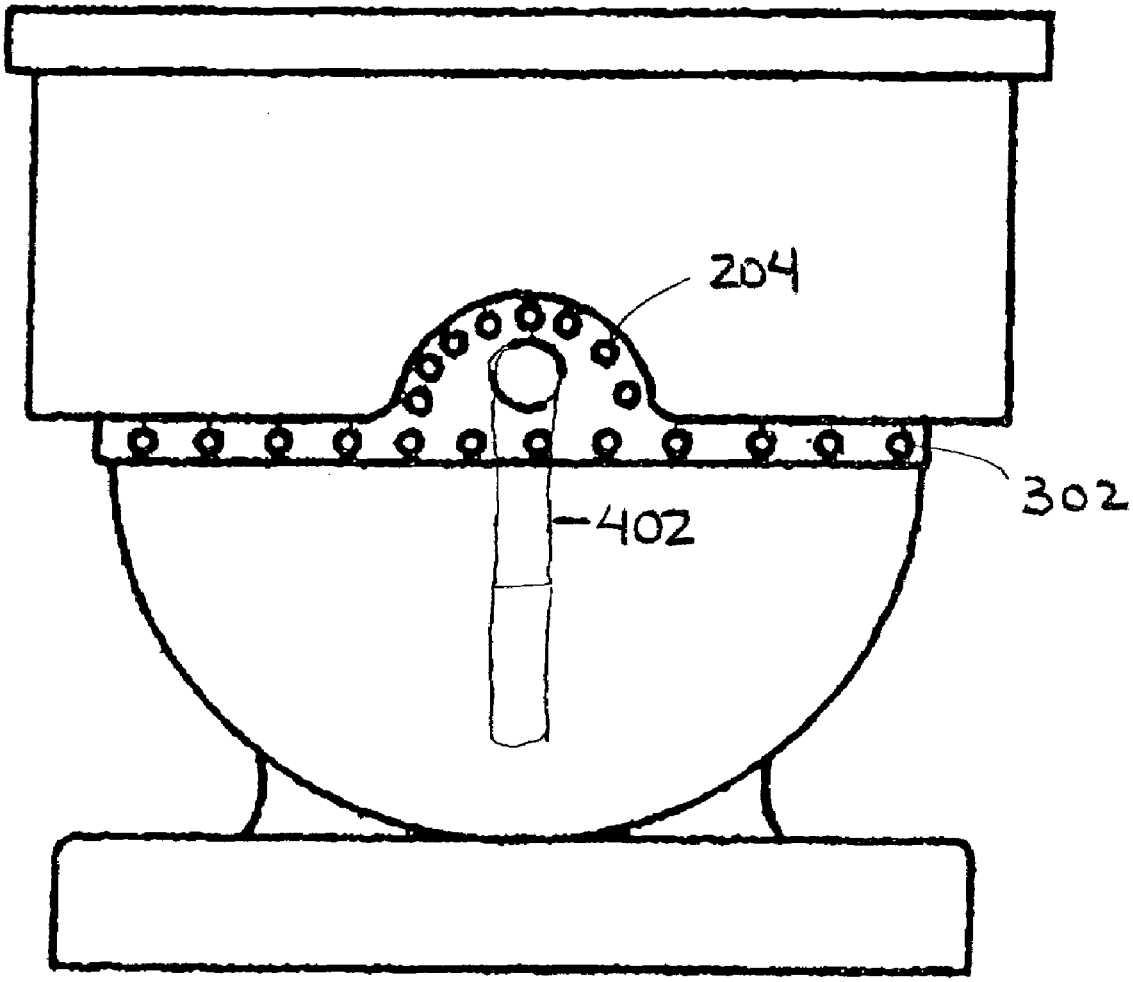
FIG. 5 is a front view of the toilet of FIG. 2.

FIG. 5 is a front view of toilet 200 of FIG. 2.

Figure 6A:
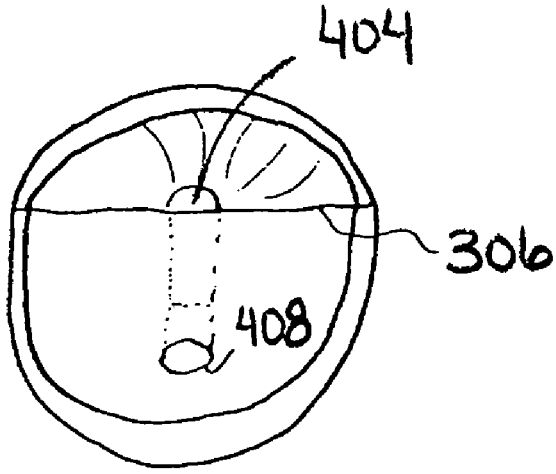
FIGS. 6A and 6B are cross-sectional views taken along line AA of FIG. 3.
Figure 6B:
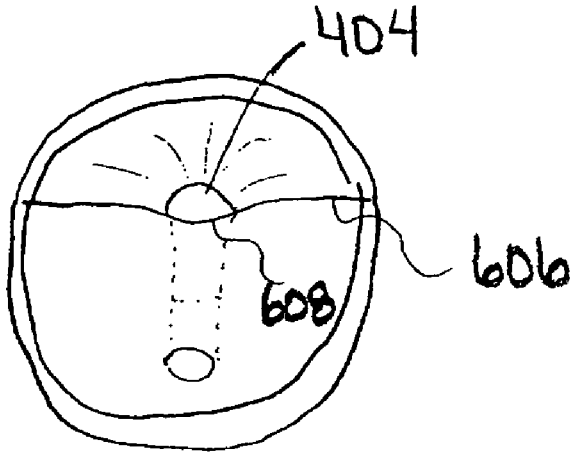

FIG. 6A is a cross-sectional view of a line AA as illustrated in FIG. 3 in accordance with one embodiment of the present invention. As illustrated in the figure, penis shelf 306 is generally planner. On the contrary, as illustrated in FIG. 6B, which depicts a second embodiment of the present invention, penis shelf 606 includes a depressed portion 608 for centering the penis with hole 404. Furthermore, in accordance with yet another embodiment of the present invention, the penis shelf can be curved and/or sloped in order to permit gravity to urge urine away from the penis towards hole 404.

Figure 7:
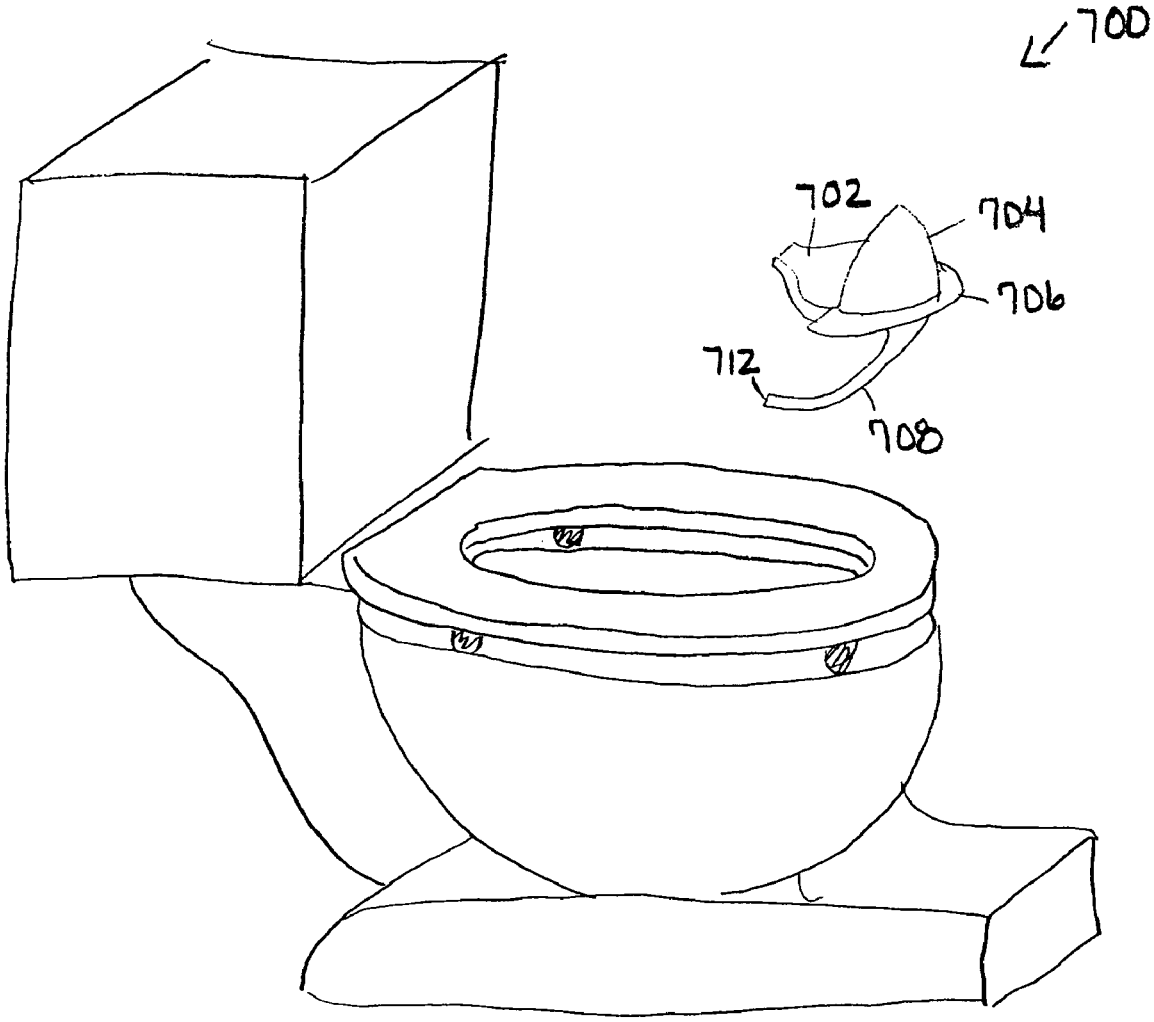
FIG. 7 is an oblique view of a toilet insert in accordance with an embodiment of the present invention for use with a conventional toilet.

A further exemplary embodiment of the present invention, for example as illustrated in FIG. 7, includes an insert 700 comprising an extended portion 704, a penis shelf 702, a disposal path 708, a trap 710 and an outlet 712. Furthermore, as illustrated in FIG. 7, the insert includes a lip 706, for resting the insert onto a seat of an existing toilet.

Figure 8A:
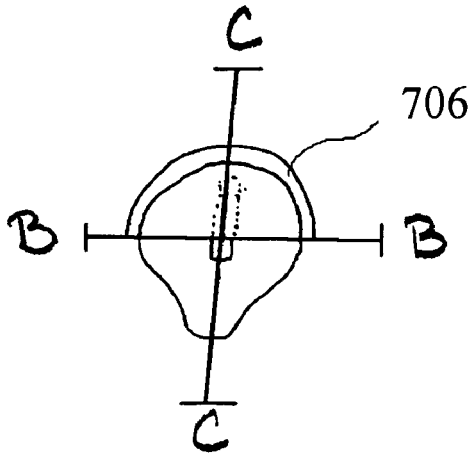
FIG. 8A is a top view of the toilet insert depicted in FIG. 7.
Figure 8B:
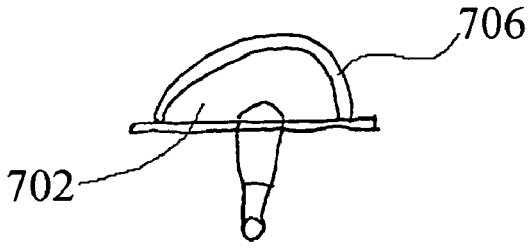
FIG. 8B is a cross-sectional view of the toilet insert taken along line BB of the FIG. 8A.
Figure 8C:
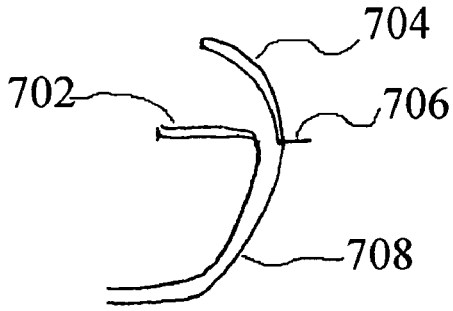
FIG. 8C is a cross-sectional view of the toilet insert taken along line CC of the FIG. 8A.

FIG. 8A illustrates a plan view of the toilet insert 700 of FIG. 7. FIG. 8B is a cross-sectional view along lines BB of FIG. 8A. FIG. 8C is a cross-sectional view along the lines of CC of FIG. 8A. as shown in FIGS. 8A–8C, the lip 706 projects radially from the penis shelf 702, and is substantially flat to allow the lip 706 to rest on the seat or the upper surface of the bowl. The lip 706 is also arcuate shape so as to wrap around a portion of the penis shelf 702.

Figure 9A:
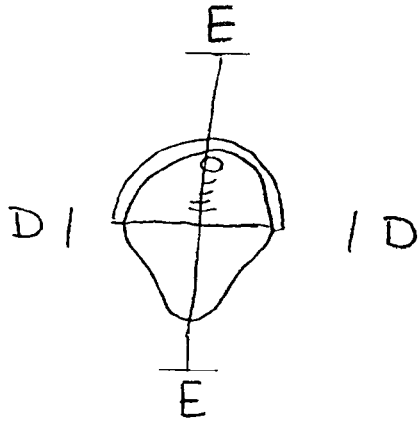
FIG. 9A is a top view of the toilet insert depicted in FIG. 8A.
Figure 9B:
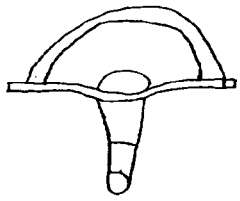
FIG. 9B is a cross-sectional view of the toilet insert taken along line BB of the FIG. 9A.
Figure 9C:
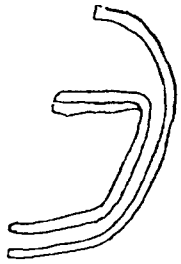
FIG. 9C is a cross-sectional view of the toilet insert taken along line CC of the FIG. 9A.

FIG. 9A is a further exemplary embodiment of the insert of FIG. 7 wherein the penis shelf includes a centering depression in order to center the penis with the hole for urine disposal.

Figure 10A:
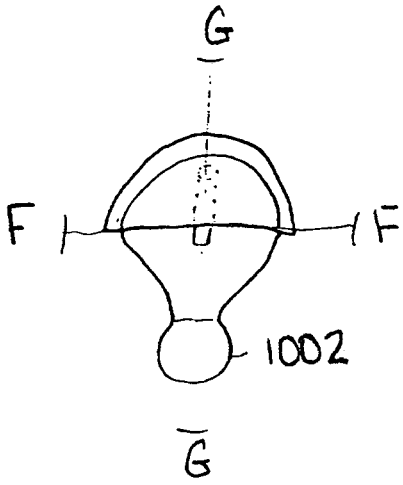
FIG. 10A is a top view of the toilet insert depicted in FIG. 9A.
Figure 10B:
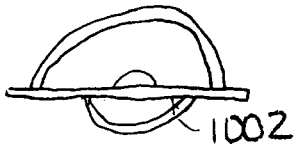
FIG. 10B is a cross-sectional view of the toilet insert taken along line BB of the FIG. 9A.
Figure 10C:
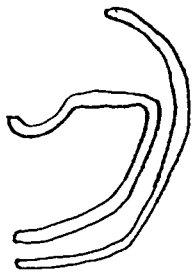
FIG. 10C is a cross-sectional view of the toilet insert taken along line CC of the FIG. 9A.

In a further exemplary embodiment, for example as illustrated in FIGS. 10A–C, the shelf may include a scrotum holding portion 1002, arranged and constructed so as to receive the scrotum of the user.

Figure 11:
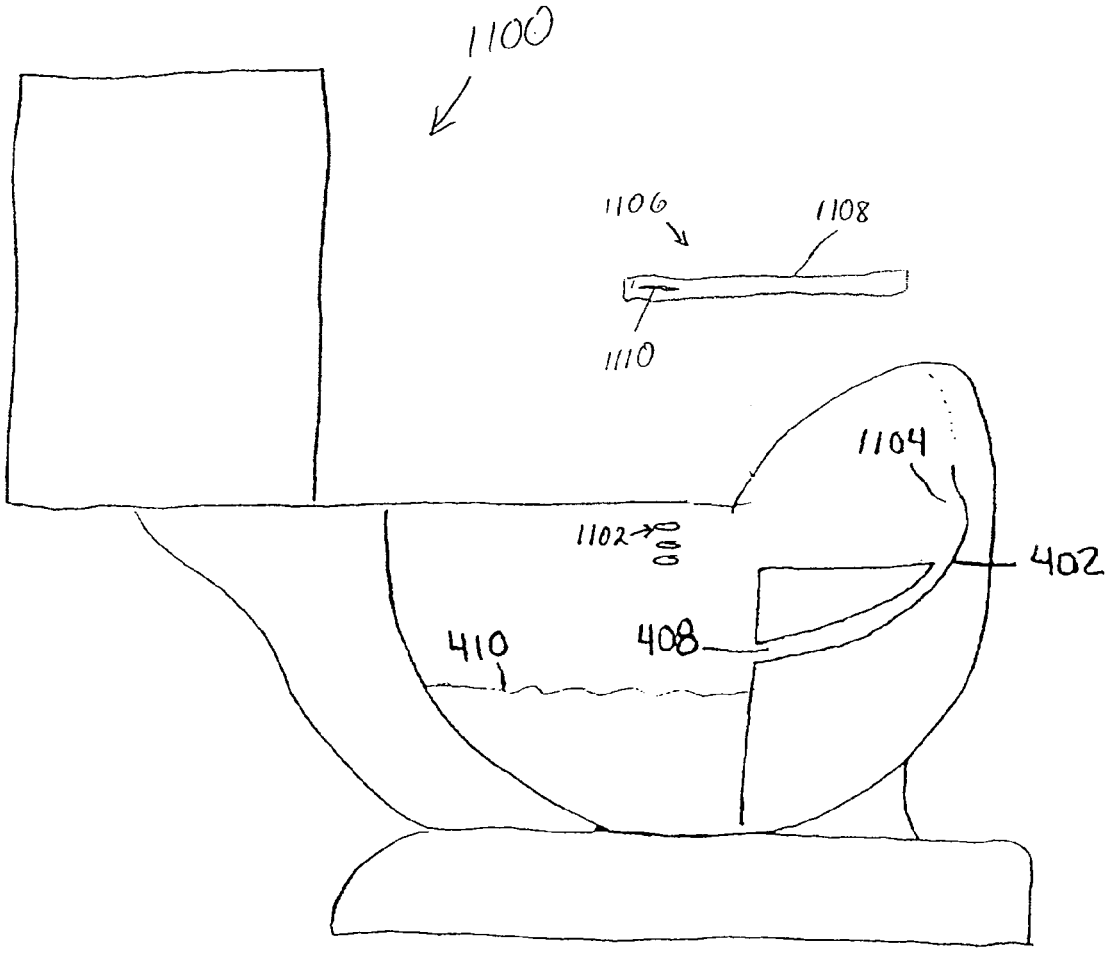
FIG. 11 is a cross sectional view of a toilet insert of a further embodiment of the present invention.
Figure 12:
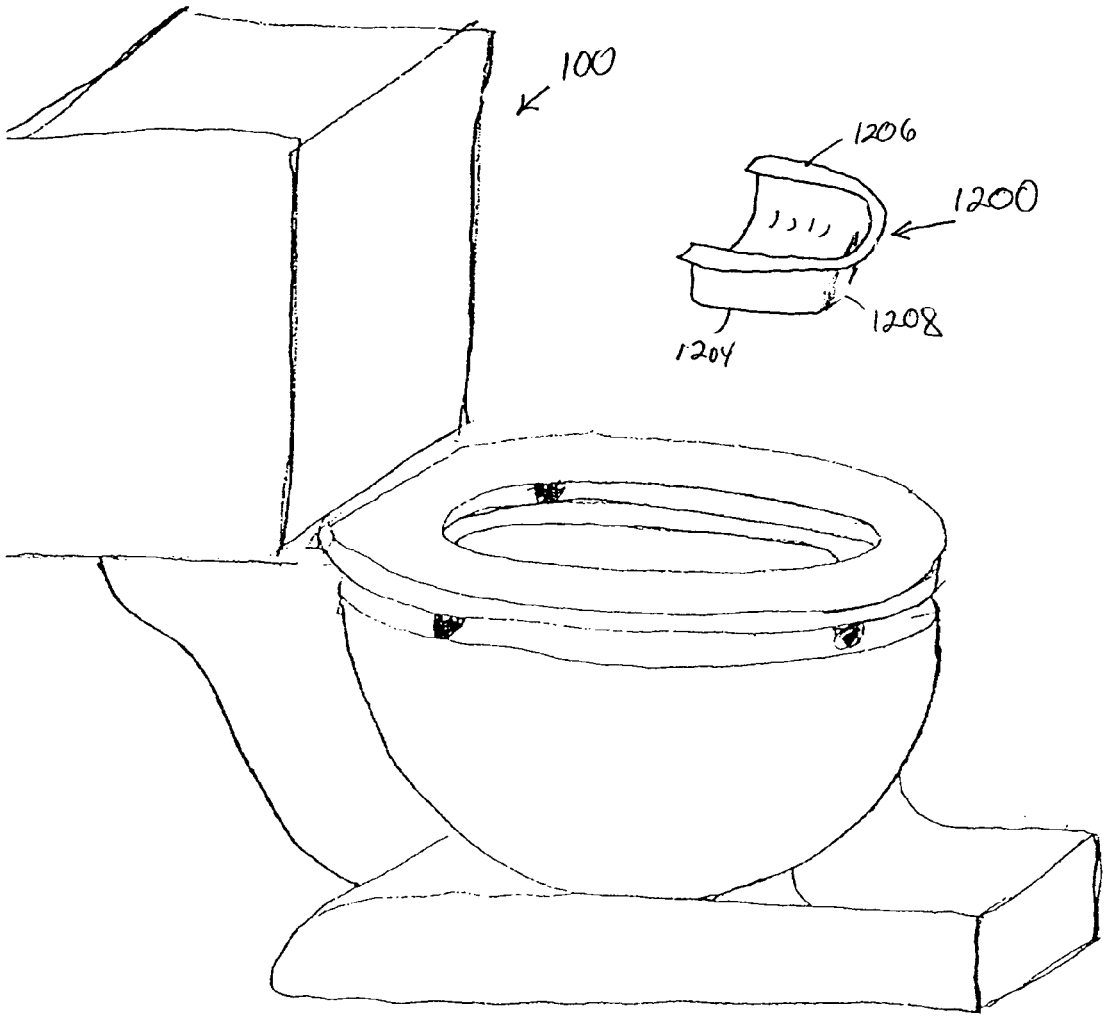
FIG. 12 is a perspective view of a toilet and toilet insert of a further embodiment of the present invention.

In a further embodiment of the present invention, for example as illustrated in FIG. 11, the toilet insert 1106 may include height adjusting tabs 1110 disposed on the side portion of platform 1108 for engaging holes 1102 in the toilet. The side adjusting tabs enable adjustment of the height of the placement of the insert for the user. FIG. 12 illusrtates yet another embodiment of a toilet insert 1200 having a platform portion 1204 with a hole 1208 formed therein, and having lip 1206 formed around platform 1204.

With respect to the above, the parts of the invention may vary in size, shape, form, function and the manner of operation, assembly and use, as deemed apparent to one skilled in the art. All specifications mentioned are intended to be included in the present convention. As changes may occur as reviewed by those skilled in the art, it is not desired to limit the invention to the exact construction and operation shown and described above. Modifications may be made as long as it holds fast the principles of the invention.

The invention claimed is:

1. A device for use with a toilet for use by a a male to sit while urinating, the toilet comprising a tank, a bowl and a base, the bowl having a back portion, a front portion and a top, the back portion being disposed between the front portion and the tank, the base being disposed so as to support the bowl, the bowl comprises a disposal path, said device comprising:

a penis shelf arranged and designed to permit a penis to rest thereon such that during urination, urine is discharged toward said disposal path;

a substantially flat lip projecting in a radial direction from said penis shelf, said lip constructed and arranged to rest on the toilet in order to permit said penis shelf to be positioned below the top of the bowl; and an extended portion located at a front portion of said penis shelf and shaped to have a height, width and curvature that prevent urine from escaping over the top of the bowl;

wherein said extended portion projects upwards from said penis shelf and said lip.

2. The device of claim 1, further comprising a disposal path portion projecting downwards said penis shelf and said lip.

* * * * *